US010040663B2

(12) United States Patent
Börger

(10) Patent No.: US 10,040,663 B2
(45) Date of Patent: Aug. 7, 2018

(54) DEVICE FOR THE TWIST-FREE WIDTH CHANGE OF A FIBER STRIP PASSING THROUGH THE DEVICE, AND SYSTEM HAVING A PLURALITY OF SUCH DEVICES

(71) Applicant: Covestro Thermoplast Composite GmbH, Markt Bibart (DE)

(72) Inventor: Herbert Börger, Langenfeld (DE)

(73) Assignee: Covestro Thermoplast Composite GmbH, Markt Bibart (DE)

( * ) Notice: Subject to any disclaimer, the term of this patent is extended or adjusted under 35 U.S.C. 154(b) by 107 days.

(21) Appl. No.: 14/917,310

(22) PCT Filed: Aug. 22, 2014

(86) PCT No.: PCT/EP2014/067905
§ 371 (c)(1),
(2) Date: Mar. 8, 2016

(87) PCT Pub. No.: WO2015/036220
PCT Pub. Date: Mar. 19, 2015

(65) Prior Publication Data

US 2016/0221789 A1 Aug. 4, 2016

(30) Foreign Application Priority Data

Sep. 10, 2013 (DE) ..... 10 2013 218 102

(51) Int. Cl.
*B65H 51/005* (2006.01)
*D01D 11/02* (2006.01)
(Continued)

(52) U.S. Cl.
CPC ..... *B65H 51/005* (2013.01); *B65H 51/015* (2013.01); *B65H 57/06* (2013.01);
(Continued)

(58) Field of Classification Search
CPC .. D02J 1/18; D02J 1/20; B65H 51/005; B65H 57/16; B65H 57/06; B65H 51/015;
(Continued)

(56) References Cited

U.S. PATENT DOCUMENTS 3,258,378 A 6/1966 Kelsey
3,358,436 A * 12/1967 Nina et al. ..... B65H 51/01 28/282

(Continued)

FOREIGN PATENT DOCUMENTS

DE 715801 C 1/1942
DE 738680 C 8/1943

(Continued)

OTHER PUBLICATIONS

English language machine translation DE 1435517 (pub. Jan. 1969), 7 pages.*

(Continued)

*Primary Examiner* — Amy Vanatta
(74) *Attorney, Agent, or Firm* — Drinker Biddle & Reath LLP

(57) ABSTRACT

The invention relates to a device (1) for the twist-free width change of a fiber strip (2) of continuous fibers (3) passing through the device (1) to a specified effective width (8). The device (1) comprises a transport unit (4) for transporting the fiber strip (2). The device (1) further comprises at least one width change assembly (5) configured such that the width change assembly (5) transfers an initial distance (a) of two adjacent fibers (3) of the fiber strip (2) to a target distance (b) of adjacent fibers (3) of the fiber strip (2). For a large part of the pairs of adjacent fibers (3), the ratio between the target distance (b) and the initial distance (a) matches within a tolerance range of 20%. This results in a reliable and economical device.

9 Claims, 4 Drawing Sheets

(51) Int. Cl.

| | |
|---|---|
| ***D02J 1/18*** | (2006.01) |
| ***B65H 51/015*** | (2006.01) |
| ***B65H 57/06*** | (2006.01) |
| ***B65H 57/16*** | (2006.01) |

(52) U.S. Cl.
CPC ..... *B65H 57/16* (2013.01); *D01D 11/02* (2013.01); *D02J 1/18* (2013.01); *B65H 2701/31* (2013.01)

(58) Field of Classification Search
CPC .... B65H 2701/31; B65H 51/26; B65H 57/02; D01D 11/02; D01D 11/04
USPC ..... 28/282
See application file for complete search history.

(56) References Cited

U.S. PATENT DOCUMENTS

| | | | | |
|---|---|---|---|---|
| 3,501,811 | A * | 3/1970 | Watson | D02J 1/18 28/220 |
| 3,840,941 | A * | 10/1974 | Neveu | B65H 51/005 28/220 |
| 3,865,565 | A * | 2/1975 | Spence | C03B 37/03 226/196.1 |
| 4,301,579 | A | 11/1981 | Van den Hoven | |
| 4,989,799 | A | 2/1991 | Nakai et al. | |
| 5,042,122 | A * | 8/1991 | Iyer | B05C 9/14 19/0.46 |
| 5,683,777 | A | 11/1997 | Dollhopf | |
| 6,021,548 | A | 2/2000 | Temburg | |
| 6,585,842 | B1 | 7/2003 | Bompard et al. | |
| 7,458,236 | B2 | 12/2008 | Kinder et al. | |
| 7,536,761 | B2 | 5/2009 | Nestler et al. | |
| 7,690,092 | B2 | 4/2010 | Wagener | |
| 8,567,024 | B2 | 10/2013 | Heinrich et al. | |
| 8,578,575 | B2 | 11/2013 | Seifert et al. | |
| 2002/0026699 | A1* | 3/2002 | Hayashi | D02J 1/18 28/282 |
| 2002/0123819 | A1 | 9/2002 | Baudry et al. | |
| 2003/0172506 | A1 | 9/2003 | Guirman et al. | |
| 2004/0043213 | A1 | 3/2004 | Tonon | |
| 2006/0151092 | A1 | 7/2006 | Day | |
| 2010/0107384 | A1* | 5/2010 | Meyer | D02J 1/18 28/282 |
| 2011/0293881 | A1 | 12/2011 | Gojny et al. | |
| 2014/0050862 | A1 | 2/2014 | Börger | |
| 2015/0259832 | A1* | 9/2015 | Oosawa | D04H 3/002 28/282 |

FOREIGN PATENT DOCUMENTS

| | | | |
|---|---|---|---|
| DE | 1435517 | A1 | 1/1969 |
| DE | 2455154 | A1 | 5/1975 |
| DE | 3942044 | A1 | 6/1990 |
| DE | 198 53 192 | A1 | 6/1999 |
| DE | 10 2005 008 705 | B3 | 9/2006 |
| DE | 10 2005 052 660 | B3 | 4/2007 |
| DE | 102006047184 | A1 | 4/2008 |
| DE | 10 2008 061 314 | A1 | 6/2010 |
| DE | 10 2009 056 189 | A1 | 6/2011 |
| DE | 10 2009 056 197 | A1 | 6/2011 |
| EP | 0 393 420 | A1 | 10/1990 |
| EP | 0 451 517 | A1 | 10/1991 |
| EP | 2 521 640 | A1 | 11/2012 |
| GB | 525320 | A | 8/1940 |
| GB | 1476929 | A | 6/1977 |
| JP | 03146736 | A * | 6/1991 |
| JP | 2007313697 | A | 12/2007 |
| WO | WO-98/44183 | A1 | 10/1998 |
| WO | WO-02/055 590 | A1 | 7/2002 |
| WO | WO-2005/087996 | A1 | 9/2005 |
| WO | WO-2012123302 | A1 | 9/2012 |

OTHER PUBLICATIONS

International Search Resort for PCT/EP2014/067905 dated Oct. 31, 2014.

* cited by examiner

DEVICE FOR THE TWIST-FREE WIDTH CHANGE OF A FIBER STRIP PASSING THROUGH THE DEVICE, AND SYSTEM HAVING A PLURALITY OF SUCH DEVICES

CROSS-REFERENCE TO RELATED APPLICATIONS

This application is a national stage application (under 35 U.S.C. § 371) of PCT/EP2014/067905, filed Aug. 22, 2014, which claims benefit of German Application No. 102013218102.7, filed Sep. 10, 2013, both of which are incorporated herein by reference in their entirety.

The content of German patent application 10 2013 218 102.7 is incorporated herein by reference.

The invention relates to a device for the twist-free width change of a fiber strip passing through the device. In addition, the invention relates to a system comprising a plurality of such devices.

BACKGROUND OF THE INVENTION

The processing of fiber strips, in particular made of continuous fibers, is previously known in an extremely wide range of designs. Examples of this are given by DE Patent 715801 A, EP 0 393 420 A, EP 0 451 517 B1, DE 198 53 192 A1, US 2002/0123819 A1, US 2003/0172506 A1, WO 98/44183 A, WO 2005/087996 A, DE 10 2005 052 660 B3, DE 10 2006 047 184 A1, DE 10 2005 008 705 B3, DE 10 2008 061 314 A1, DE 10 2009 056 197 A1 and DE 10 2009 056 189 A1.

BRIEF SUMMARY OF THE INVENTION

Despite the many different approaches to the processing of fiber strips, in particular made of continuous fibers, there is still a demand for a device that is operationally reliable and as uncomplicated as possible for the twist-free width change of a fiber strip made of continuous fibers passing through the device to a predefined useful width.

It is therefore an object of the present invention to devise an appropriate device.

According to the invention, this object is achieved by a device having the features specified in claim 1.

DETAILED DESCRIPTION OF THE INVENTION

According to the invention, it has been recognized that the twist-free width change of a fiber strip to a predefined useful width is a matter of changing the fiber spacings between adjacent fibers uniformly, so that the spacings between adjacent individual fibers match within a predefined tolerance band. This leads to good processability of the width-changed fiber strip, so that uniform, defined laid-fabric conditions are present over the entire width of the fiber strip. The fiber strip which has passed through the device constitutes a unidirectional surface structure with a defined and uniformly forming weight per unit area. The fiber strip can be a yarn or a roving. The fiber strip treated in this way can be subjected to further treatment in order to produce a pre-preg or a tape, for example, in particular impregnation with a plastic matrix. Alternatively, it is possible firstly to wind up the fiber strip thus treated, for example dry, and to store the same intermediately before further processing. In a further treatment variant the twist-free width change of the fiber strip made of continuous fibers passing through the device to a predefined useful width can take place with an already impregnated fiber strip, that is to say not in the "dry" state but in the "wet" state of the fiber strip. The impregnating polymer used can be a thermoplastic. Examples thereof are PE (polyethylene), PP (polypropylene), other polyolefines and blends of said polyolefines, SAN (styrene/acrylonitrile), PA (polyamide), for example PA 6, PA 6.6, PA 6.6T, PA 12, PA 6.10, ASA (acrylonitrile/styrene/acrylic ester), PC (polycarbonate), PBT (polybutylene terephthalate), PET (polyethylene terephthalate), PPS (polyphenylene sulfide), PSU (polysulfone), PES (polyether sulfone), PEEK (polyether ether ketone) or polymer blends, for example PC/PBT. The impregnating polymer used can also be a thermosetting plastic, which can be applied as melt at the B stage (Resitol).

Preferably, all the pairs of adjacent fibers match in terms of the ratio between the target spacing and the initial spacing, within the tolerance band of 20%. The match can lie within a tolerance band of 15%, within a tolerance band of 10% or else within a still narrower tolerance band.

The use of at least one further width change assembly, as claimed in claim 2, makes it possible, for example, initially to spread out the fiber strip with the first width change assembly and then to join the same together again with the further width change assembly. In the spread-out state, the individual fiber strips are then separated more highly from one another, which can be used to detach adhesions between the individual fibers. This detachment of adhesions is of particular advantage especially for a following impregnation step. In addition, the configuration in which the fiber strip is initially spread apart and then joined together again can be advantageous when processing an already impregnated, that is to say "wet", fiber strip. If more than one width change assembly is used in the device, both width change assemblies can also spread apart the fiber strip step by step or join the same together step by step. In this way, very high spreading or joining ratios can be achieved. It is also possible for more than two width change assemblies to be used in the device, for example three or an even greater number of width change assemblies.

An edge stop as claimed in claim 3 leads to a particularly operationally reliable width change device. The edge stop can be chosen such that the fiber strip has a constant fiber density over its entire width. The fiber density of the fiber strip then does not decrease in the edge region, as is the case in conventionally produced fiber strips. During the production of overall fiber strips by means of laying a plurality of individual fiber strips beside one another, no overlap of the individual fiber strips in the edge region is required anymore, which increases the quality of the overall fiber strip produced. The fiber strip produced by using the device has a rectangular profile, which can be attached seamlessly to an adjacent fiber strip.

In the case of a width change assembly as claimed in claim 4, use is made of geometric principles which are known from optics in guiding light in telescopes. The two guide contours in this case behave similarly to collecting or refracting lenses of an optical telescope. It is possible in particular to use principles which are known in the construction of Galilean telescopes. In this case, the ratio of the contour radii of the two guide contours of the width change assembly corresponds to the ratio of the lens focal lengths. A width change to be predefined can be predefined exactly via the ratio of the contour radii. In this case, virtually identical but in any case comparable forces act on the individual fibers within the fiber strip, so that the resultant fiber strip can be implemented in an intrinsically stress-free manner.

Partial circumferential utilizations as claimed in claims 5 and 6 have proven to be worthwhile in practice. Alternatively, the respective guide contour can also be shaped in such a way that it has a contour section which corresponds to the partial circumference of a correspondingly complete circular contour body. The guide contours can therefore be implemented as complete circles, of which only a partial circle is used, or as partial circles.

The ability to displace components located at the top as claimed in claim 7 facilitates threading of the fiber strip as the device is started up and also facilitates accessibility to the fiber strip during maintenance of the device. The ability to be displaced can in particular be an ability to fold the component located at the top. The respective components located at the top can have appropriate articulated connections for the folding.

A heating unit as claimed in claim 8 can additionally be used to assist the detachment of an adhesion of individual fibers. If an already impregnated, that is to say "wet", fiber strip is processed with the width change device, the heating unit can be used to ensure a predefined ability of the polymer matrix used for the impregnation to flow freely. In addition, other treatment steps can be prepared by the heating.

The advantages of the system as claimed in claim 9 correspond to those which have already been explained above in conjunction with the discussion of the width change device according to the invention. The system can have a plurality of identically constructed width change assemblies of the type of the above-described width change assemblies, which are arranged beside one another. It is possible to produce wide overall fiber strips with a weight per unit area that is uniform within narrow tolerances.

Different working planes as claimed in claim 10 permit the fiber strips to be guided with advantageously few components, and also a compact configuration of an overall processing installation containing the system.

Exemplary embodiments of the invention will be explained in more detail below by using the drawings, in which:

Figure 1:
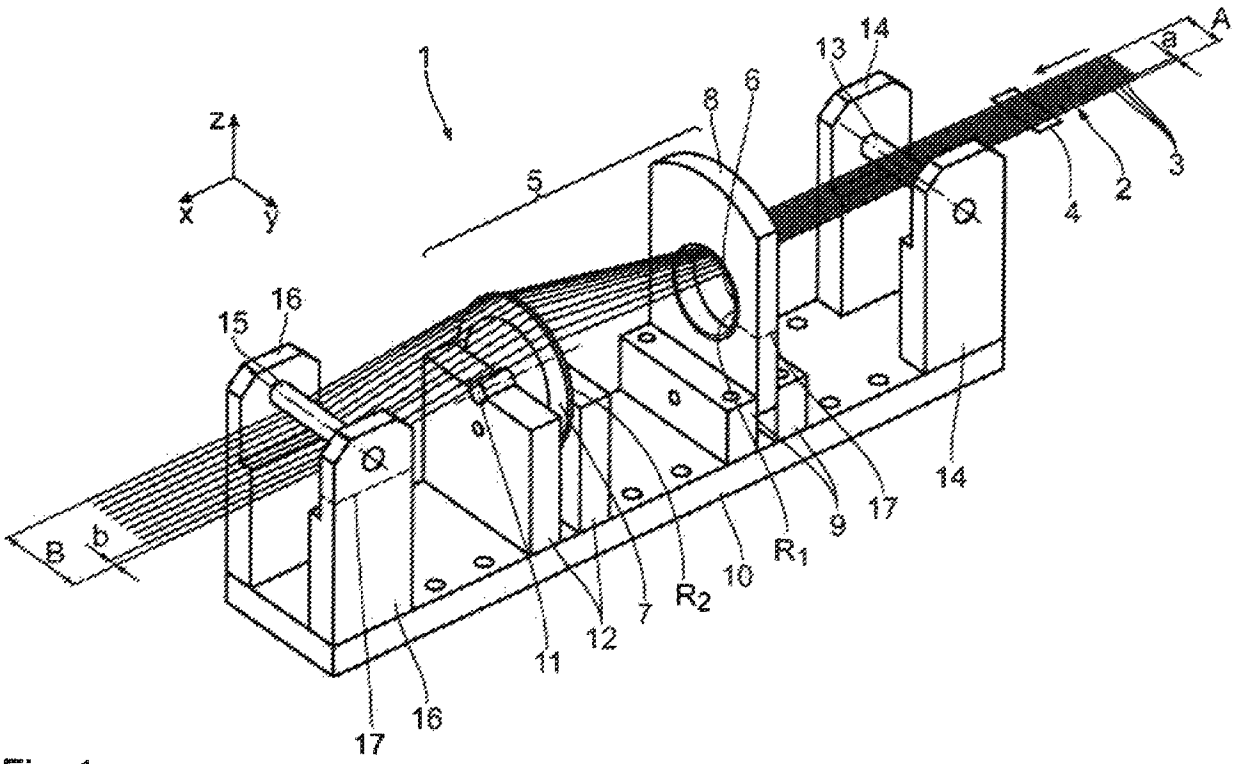
FIG. 1 shows, in a perspective view, a device for the twist-free width change, namely for spreading a fiber strip made of continuous fibers passing through to a predefined useful width.

A width change device 1 is used for the twist-free width change of a fiber strip 2 made of continuous fibers 3 passing through the device to a predefined useful width B. The fiber strip 2 runs into the device 1 with an initial width A. The fiber strip 2 is fed to the device 1 with the aid of a transport unit 4, illustrated extremely schematically in FIG. 1, which unit can be, for example, a pair of transport belts and/or transport rolls rotating in opposite directions.

The device 1 has a width change assembly 5. This is designed in such a way that it changes an initial spacing a of two adjacent fibers 3 of the fiber strip 2 to a target spacing b of adjacent fibers 3 of the fiber strip 2. The ratio b/a between the target spacing b and the initial spacing a matches for all the pairs of adjacent fibers 3 of the fiber strip 2, within a tolerance band of 20%.

The fiber strip 2 can be a yarn or a roving. The fiber material used for the fiber strip 2 can be glass fibers, carbon fibers, aramid, basalt, quartz fibers, boron fibers, synthetic fibers, polyester or natural fibers. Other fiber materials can also be used if non-rotated, parallel fibers are present. The number of individual continuous fibers 3 of the fiber strip 2 is illustrated in a highly understated manner in the drawing. In actual fact, several thousand individual fibers 3 may be present in the fiber strip 2, for example several tens of thousands, for example 50,000, individual fibers 3. If use is made of fiber strips with glass fibers, these can have, for example, 1000 to 10,000 individual fibers, for example 2400 or 4800 individual fibers. The fiber strip 2 to be processed in the device 1 can be a dry fiber strip, that is to say one not yet impregnated, or alternatively a wet fiber strip, that is to say one already impregnated in a preparation step.

The width change assembly 5 comprises a first partially circular guide contour 6 having a first contour radius $R_1$. The first guide contour 6 is located in an arrangement plane yz perpendicular to a transport direction x of the fiber strip 2. The coordinates x, y, z span a Cartesian coordinate system in FIG. 1.

The width change assembly 5 further includes a second partially circular guide contour 7 having a second contour radius $R_2$, which is located in a further arrangement plane yz perpendicular to the transport direction x of the fiber strip 2.

The first guide contour 6 is implemented as a circular passage opening in a guide body 8, which is mounted so as to be clamped between two mounting blocks 9 on a base plate 10 of the width change device 1. The overall circularly designed first guide contour 6 is used only in a partial circular section, illustrated at the top in FIG. 1, in an inner circumferential region covering approximately 60°. The first guide contour 6 is therefore used on a partial inner circumference.

The second guide contour 7 is formed as the outer circumference of a circular guide disk, which is likewise used in an upper partial circular section over a circumferential angle of about 60°. The guide contour 7 is therefore used on a partial outer circumference. The guide disk 7 has an axial positioning pin 11, which extends coaxially with respect to an axis of rotational symmetry of the guide disk 7 and, on both sides, projects beyond a disk plane of the guide disk 7. These projecting ends of the positioning pin 11 go into recesses complementary thereto in mounting blocks 12, between which guide disk 7 is clamped. The mounting blocks 12 are in turn mounted on the base plate 10.

The two guide contours 6, 7 are arranged coaxially with respect to each other, the axis of rotational symmetry of the two guide contours 6, 7 coinciding and extending parallel to the x axis, that is to say parallel to the transport direction of the fiber strip 2 before the width change assembly 5.

The fiber strip 2 is guided over the two guide contours 6, 7 such that the individual fibers 3 rest on both guide contours 6, 7. The two guide contours 6, 7 follow each other directly in the conveying path of the fibers 3 without any interposed guide components for the fibers 3.

After being joined together, the fiber strip 2 can have a width B of, for example, 10 mm to 15 mm. Such a width, for example in the range between 12 mm and 13 mm, is suitable in particular for winding up the fiber strip 2 on conventional cross-wound spools.

It can be shown that the ratio b/a and therefore also the ratio B/A corresponds to the ratio $R_2/R_1$. The width change device 1 according to FIG. 1 is used to spread out the fiber strip 2. In the width change device 1 used for the spreading, it is therefore true that A<B and a<b.

In the guide path of the fiber strip 2 before the first guide contour 6, the fiber strip 2 runs over an inlet guide rod 13 located at the bottom for the predefinition of an inlet transport plane parallel to the xy plane. The inlet guide rod 13 is fixed between two mounting cheeks 14 which, for their part, are mounted on the base plate 10.

In the transport path after the second guide contour 7, the spread-out fiber strip 2 runs under an outlet guide rod 15, via which a defined outlet plane for the spread-out fiber strip 2 is predefined, once more extending parallel to the xy plane. The outlet guide rod 15 is once more fixed between two mounting cheeks 16, which, for their part, are mounted in the base plate 10. The mounting cheeks 16 can be used at the same time as edge stops for the defined guidance of the lateral edges of the outgoing fiber strip 2.

The guide rods 13, 15 extend parallel to the y direction.

If the fiber strip 2 is guided between components located at the top and at the bottom, the components respectively located at the top can be displaced between an operating position and a release position. In the width change device 1, the components located at the top in this respect are firstly the used circumferential section of the first guide contour 6 and secondly the outlet guide rod 15 located at the top. The associated supporting elements of these components can be divided in a dividing plane 17, as indicated dashed in FIG. 1 in the region of the guide body 8, on the one hand, and the mounting cheeks 16, on the other hand. Via a division of this type and an appropriately designed articulated connection, firstly the guide body 8 and secondly the guide rod 15 can be pivoted between the operating position shown in FIG. 1 and a release position, the fiber strip 2 respectively being accessible from above in the release position of the two components 8 and 15 located at the top, which can be used to set up the width change device 1 or else for mounting and adjustment purposes.

An inlet working plane in the conveying path of the fiber strip 2 before the guide rod 13 and an outlet conveying plane of the fiber strip 2 in the conveying path after the outlet guide rod 15 can coincide. Alternatively, these two working planes can also be spaced apart from each other, so that the fiber strip 2 is transported on different working planes in different sections of its conveying path in the region of the width change device 1.

By using FIG. 2, a further embodiment of a width change device 18 will be explained below. Components which correspond to those which have already been explained above with reference to the embodiment according to FIG. 1 bear the same reference numbers and will not be discussed in detail again.

The width change device 18 is used to join an incoming fiber strip 2 together. Here, it is therefore true that: A>B and a>b.

In the width change device 18, the inlet guide rod 13 is implemented at the top in relation to fiber strip 2, and the outlet conveying rod 15 is implemented at the bottom in relation to the fiber strip 2. The first partially circular guide contour 6 is implemented as a guide disk of the type of the guide disk 7 of the embodiment according to FIG. 1. The first guide contour 6 in the width change device 18 in turn has a first contour radius $R_2$.

The second partially circular guide contour 7 in the width change device 18 is implemented as a passage opening with internal contour radius $R_3$, corresponding to the guide contour 6 of the width change device 1.

A contour radius $R_3$ of the second guide contour 7 of the width change device 18 is greater than the contour radius $R_1$ of the first guide contour 6 of the width change device 1 according to FIG. 1.

Figure 2:
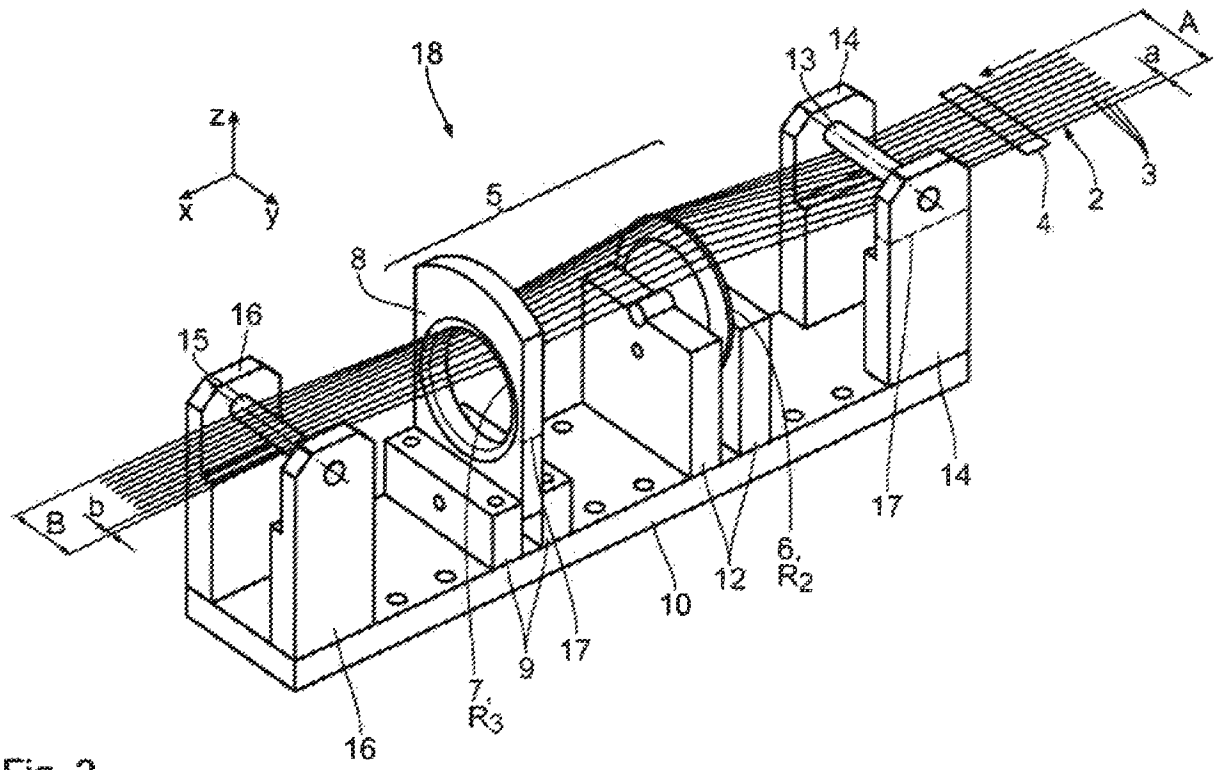
FIG. 2 shows an illustration similar to FIG. 1 of a further embodiment of a width change device for joining continuous fibers of a fiber strip together.

The contour radius $R_2$ of the first guide contour 6 according to FIG. 2 is exactly as large as the contour radius $R_2$ of the guide contour 7 according to FIG. 1.

Here, it is accordingly true that $B/A=b/a=R_3/R_2$.

It is also true that $R_3/R_2>R_1/R_2$.

Apart from the different ratio $R_3/R_2$ as compared with $R_1/R_2$, the width change device 18 can be understood as an inversion of the width change device 1. It is therefore readily possible to use the width change device 1 as a joining device, in which the transport direction +x of the fiber strip 2 is simply inverted (−x) by the width change device 1. The fiber rod 15 then becomes the inlet fiber rod. The guide contour 7 then becomes the first guide contour. The guide contour 6 then becomes the second guide contour. The guide rod 13 then becomes the outlet guide rod. In an entirely corresponding way, width change device 18 can also be used to spread the fiber strip 2 by inverting the transport direction for the fiber strip 2. The outlet guide rod 15 then becomes the inlet guide rod. The guide contour 7 then becomes the first guide contour. The guide contour 6 then becomes the second guide contour, and the guide rod 13 then becomes the outlet guide rod.

Figure 3:
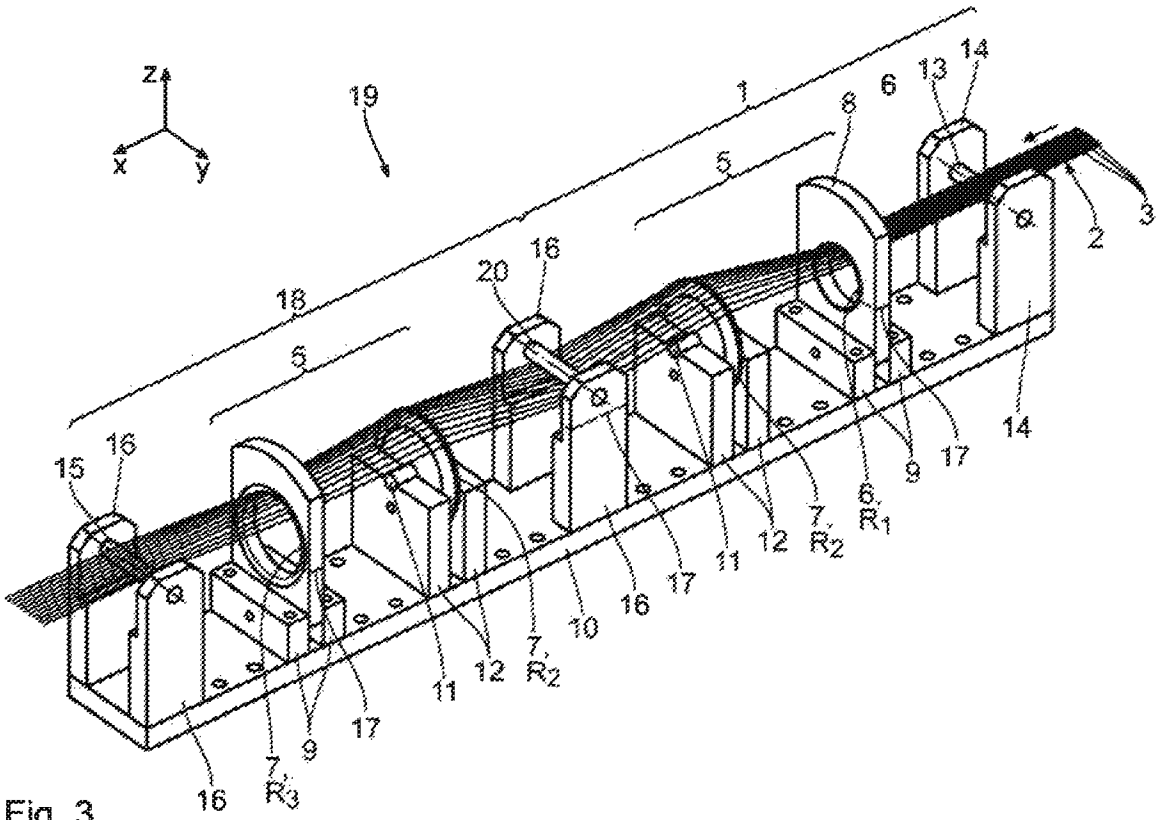
FIG. 3 shows, in an illustration similar to in FIG. 1, a further embodiment of a width change device for spreading a fiber strip passing through, the fiber strip in the meantime being spread apart more highly than after the complete passage through the width change device.

FIG. 3 shows a further embodiment of a width change device 19. Components which correspond to those which have already been explained above with reference to the embodiment according to FIGS. 1 and 2 bear the same reference numbers and will not be discussed in detail again.

The width change device 19 constitutes a series connection of the width change devices 1 and 18. An outlet guide rod 20 of the width change device 1 is simultaneously the inlet guide rod for the following width change assembly 5 corresponding to the width change device 18. This guide rod will also be designated as an intermediate guide rod 20 below. The incoming fiber strip 2 is firstly spread out in the ratio $R_2/R_1$ in the width change device 19 and then joined together in the ratio $R_2/R_3$. This results in a net spreading in the ratio $R_3/R_2$.

In the region of the intermediate guide rod 20, the fiber strip 2 is therefore present in an even more highly spread form than in the region of the outlet guide rod 15 after the second width change assembly 5 of the type of the width change device 18. This maximum spreading of the fiber strip 2 in the region of the intermediate guide rod 20 can be used, for example, for an intermediate treatment of the fibers 3 of the fiber strip 2.

This spreading to an initially greater width can also be used to detach an adhesion of the incoming individual fibers 3, that is to say to open the incoming fiber strip. A defined subsequent impregnation of the outgoing fiber strip can then be ensured, an impregnating material obtaining access to all the individual fibers.

Figure 4:
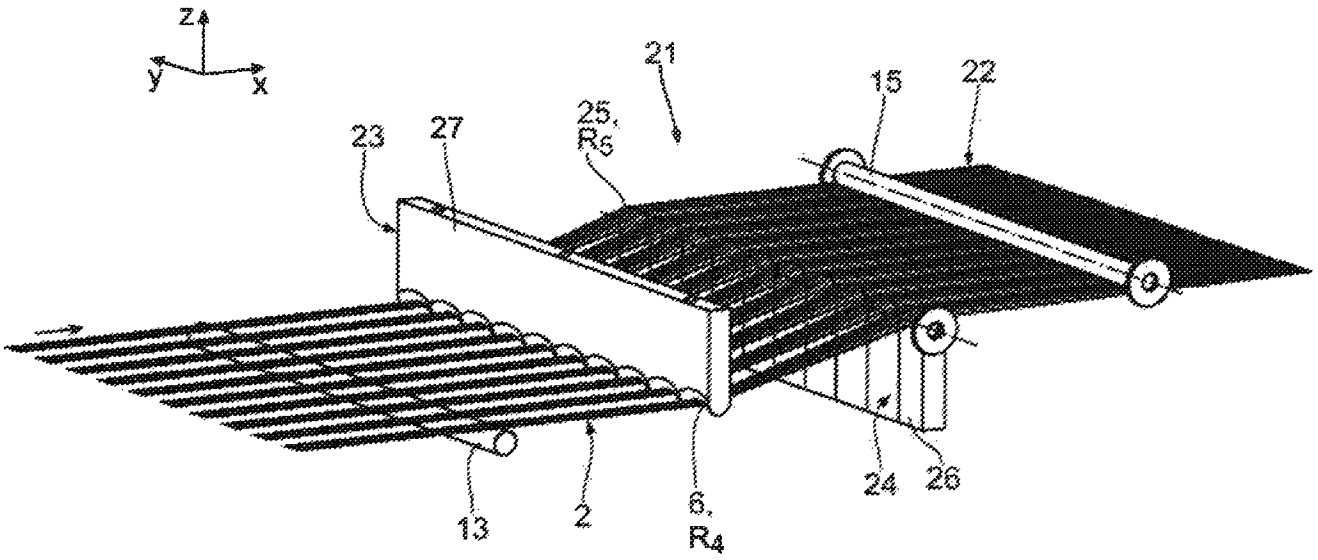
FIG. 4 shows a system comprising a plurality of width change devices of the type according to FIG. 1, arranged beside one another, for producing a combined overall fiber strip made of a plurality of fiber strips arranged beside one another, which are spread apart beside one another by the width change devices of the system according to FIG. 4.

FIG. 4 shows a fiber strip joining system 21. This has a plurality of width change devices for spreading out individual fiber strips 2 of the type of the width change device 1, which are arranged beside one another, that is to say offset in relation to one another in the y direction. The system 21 is used to produce a combined overall fiber strip 22 from the spread-out individual fiber strips 2 arranged beside one another.

A first overall guide contour 23 of the system 21 is formed from an appropriate multiplicity of first partially circular inner guide contours 6 of the type of the width change device 1 that are located beside one another. FIG. 4 illustrates only a used upper and inner circumferential section of the guide contours 6 located beside one another. A second overall guide contour 24 of the system 1 is formed from a multiplicity of partially circular outer circumferential guide contours, which in turn are located arranged beside one another in a corresponding multiplicity. Differing, for example, from the second guide contour 7 of the width change device 1, the individual partially circular guide contours 25 of the second overall guide contour 24 are not part of an overall guide disk but constitute upper partially circular contour sections of otherwise cuboidal contour carriers 26. The contour carriers 26 are firmly connected to one another in a manner comparable with a carrying body 27 of the first overall guide contour 23, and can, for example, be implemented as a one-piece overall body.

In the system 21, for the ratio $R_5/R_4$ of the radii, as compared with the ratio $R_2/R_1$ of the radii of the width change device 1 according to FIG. 1, it is true that:

$$R_5/R_4 >> R_2/R_1,$$

Because of this highly different ratio of the radii, the result is that an inlet working plane which is predefined by a position of the inlet guide rod 13 of the system 21 is located lower down in the z direction, that is to say is spaced apart from an outlet guide plane which is predefined by the position of the outlet guide rod 15 of the system 21. The incoming fiber strips 2 are therefore transported on a different working plane than the outgoing overall fiber strip. This can be used, for example, in an overall treatment process, for example during roving production, to carry out treatment steps at levels arranged one above another and thus in a space-saving manner.

The overall fiber strip 22 can have an overall width of several hundred millimeters in the y direction.

Overall, in the system 21 according to FIG. 4, ten individual fiber strips 2 are joined together to form the overall fiber strip 22. Depending on the design of the system 21, the number of individual fiber strips 2 that are joined together can be different and can, for example, move in the range between 2 and 50.

The overall fiber strip 22 spread out in this way can be used as a precursor in the production of a fiber composite material in the form of an overall fiber strip impregnated with a polymer, which is also designated as a tape. Examples relating to the processing of such a fiber composite are specified, for example, in EP 2 521 640 A1.

The width changes of the individual fiber strips 2 explained above are produced without any twist, that is to say without twisting the individual continuous fibers 3.

The aim of the spreading is the production of a unidirectional surface structure (i.e. of the fiber strip with a weight per unit area that is defined and formed as uniformly as possible). The fiber strips 2 and 22 provided with the aid of the width change devices 1, 18, 19 described or with the system 21 can subsequently be impregnated, for example, with a thermoplastic polymer melt or with a reactive resin mixture and, after that, used further as in particular unidirectional pre-pregs or tape. The fiber strip produced can alternatively also be stored temporarily as fiber strip from a spool and further processed later. The fiber strip that is stored temporarily, that is to say for example wound up, can be a dry fiber strip or else one that is already impregnated, that is, wet. A corresponding fiber strip can be used in a device for producing multiaxial fiber fabrics. One example of this is multiaxial knitted fabrics.

Before the entry of the fiber strip, for example in the region of the transport unit 4 illustrated before the inlet conveying rod 13 in FIG. 1, a heating unit for heating incoming fiber strip 2 can be provided. The heating unit can heat the fiber strip 2 via hot air, via IR radiation or via contact heat. When conductive materials are used, the heating can also be done by introducing current, in particular direct current, through the fibers 3 of the fiber strip 2.

The invention claimed is:

1. A device for the twist-free width change of a fiber strip made of a plurality of continuous fibers passing through the device to a predefined width (B), comprising a transport assembly for transporting the fiber strip, at least one width change assembly which changes an initial spacing (a) of two adjacent fibers of the fiber strip to a target spacing (b) of adjacent fibers of the fiber strip, the ratio between the target spacing (b) and the initial spacing (a) for all pairs of adjacent fibers matching within a tolerance band of 20%;

wherein the at least one width change assembly has:

a first partially circular guide contour having a first contour radius that is located in an arrangement plane (yz) perpendicular to a transport direction (x) of the fiber strip, a second partially circular guide contour having a second contour radius which lies in a further arrangement plane (yz) perpendicular to the transport direction (x) of the fiber strip, the two partially circular guide contours being arranged coaxially, the fiber strip being guided over the two guide contours such that the individual fibers rest on both guide contours, the two guide contours following each other directly without any interposed guide components.

2. The device as claimed in claim 1, wherein at least one further width change assembly, which changes an initial spacing (a) of two adjacent fibers of the fiber strip to a target spacing (b) of adjacent fibers of the fiber strip, the ratio between the target spacing (b) and the initial spacing (a) for all the pairs of adjacent fibers matching within a tolerance band of 20%.

3. The device as claimed in claim 1, wherein the at least one width change assembly has an edge stop for defined guidance of all the edges of the fiber strip.

4. The device as claimed in claim 1, wherein the fiber strip is passed through a portion of an inner circumference of at least one of the guide contours.

5. The device as claimed in claim 1, wherein the fiber strip is passed over a portion of an outer circumference of at least one of the guide contours.

6. The device as claimed in claim 1, wherein the device has a top and a bottom, and wherein the fiber strip is guided between components located at the top and components located at the bottom, wherein at least some of the components located at the top have an operating position and a release position, in which the fiber strip is accessible from above.

7. The device as claimed in claim 1, comprising a heating unit for heating the fiber strip before entry into the at least one width change assembly.

8. A system comprising a plurality of devices as claimed in claim 1 to produce a combined overall fiber strip made of a plurality of fiber strips arranged beside one another.

9. The system as claimed in claim 8, wherein at least sections of the devices transport the fiber strips on different working planes.

* * * * *